US011844731B2

(12) United States Patent
Kavoori Sethumadhavan et al.

(10) Patent No.: US 11,844,731 B2
(45) Date of Patent: Dec. 19, 2023

(54) SYSTEMS AND METHODS FOR INDICATING AN OPEN PORTHOLE IN AN INFANT CARE STATION

(71) Applicant: GE Precision Healthcare LLC, Wauwatosa, WI (US)

(72) Inventors: Nagapriya Kavoori Sethumadhavan, Bangalore (IN); Rajendra Naik, Bangalore (IN); Steven J. Woloschek, Wauwatosa, WI (US)

(73) Assignee: GE Precision Healthcare LLC, Wauwatosa, WI (US)

( * ) Notice: Subject to any disclaimer, the term of this patent is extended or adjusted under 35 U.S.C. 154(b) by 0 days.

(21) Appl. No.: 18/175,588

(22) Filed: Feb. 28, 2023

(65) Prior Publication Data

US 2023/0201060 A1 Jun. 29, 2023

Related U.S. Application Data

(63) Continuation of application No. 17/399,820, filed on Aug. 11, 2021, now Pat. No. 11,596,566.

(30) Foreign Application Priority Data

Aug. 12, 2020 (IN) ..... 202041034578

(51) Int. Cl.

| | |
|---|---|
| ***A61G 11/00*** | (2006.01) |
| ***F21V 23/04*** | (2006.01) |
| ***F21S 9/02*** | (2006.01) |
| *F21Y 115/10* | (2016.01) |

(52) U.S. Cl.

CPC ..... *A61G 11/009* (2013.01); *F21S 9/02* (2013.01); *F21V 23/04* (2013.01); *A61G 2203/20* (2013.01); *A61G 2203/30* (2013.01); *A61G 2203/70* (2013.01); *F21Y 2115/10* (2016.08)

(58) Field of Classification Search

CPC ..... F21V 23/04; F21S 9/02; A61G 11/005; A61G 11/006; A61G 11/009

See application file for complete search history.

(56) References Cited

U.S. PATENT DOCUMENTS 5,730,355 A * 3/1998 Lessard ..... A61G 11/00 454/195

2017/0135888 A1* 5/2017 Wakabayashi ..... A61G 11/009

* cited by examiner

*Primary Examiner* — Evan P Dzierzynski
*Assistant Examiner* — Nathaniel J Lee

(57) ABSTRACT

A system for safely containing an infant on a mattress is described. The system includes a plurality of panels that extend upwardly from a base that supports the mattress, wherein the plurality of panels and the base form an enclosure around the mattress, and wherein at least one of the plurality of panels is configured to have a locked position and an unlocked position. The system also includes a detection system that detects when the at least one of the plurality of panels is in the unlocked position and a lighting system operatively coupled to the detection system, wherein the lighting system is configured to emit light when the at least one of the plurality of panels is detected to be in the unlocked position. Furthermore, the system includes a power system that provides energy to the lighting system for emitting the light.

20 Claims, 7 Drawing Sheets

SYSTEMS AND METHODS FOR INDICATING AN OPEN PORTHOLE IN AN INFANT CARE STATION

CROSS-REFERENCE TO RELATED APPLICATIONS

This application is a continuation of U.S. patent application Ser. No. 17/399,820, filed Aug. 11, 2021, which claims the benefit of Indian Provisional Patent Application No. 202041034578, filed Aug. 12, 2020. The entire contents of both U.S. patent application Ser. No. 17/399,820 and Indian Provisional Patent Application No. 202041034578 are hereby incorporated by reference for all purposes.

FIELD

The present disclosure generally relates to systems and methods for indicating an open porthole in an infant care station, and more particularly to systems and methods for indicating an open porthole in an infant care station, particularly via illumination of porthole doors when open.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure generally relates to a system for safely containing an infant on a mattress. The system includes a base that supports the mattress and panels that extend upwardly from the base and together form an enclosure around the mattress. A porthole is defined through at least one of the panels, where the porthole provides access into the enclosure. A porthole door has locked and unlocked positions and covers the porthole in the locked position. A detection system detects when the porthole door is in the unlocked position. A lighting system is operatively coupled to the detection system and is configured to emit light when the porthole door is detected to be in the unlocked position. A power system provides energy to the lighting system for emitting the light.

In one aspect, the system can include a latch for selectively unlocking the porthole door, wherein the detection system is a limit switch incorporated within the latch. In another aspect, the light is emitted by only one light emitting diode (LED). In some examples, an edge of the porthole door is configured to scatter light such that the edge is illuminated by the light emitted from the lighting system. In one aspect, the edge of the porthole door is laser etched. In some examples, a text message is defined within the porthole door such that the text message is illuminated by the light emitted from the lighting system.

In one aspect, the power system receives energy at least in part from an energy harvesting system. In some examples, the energy harvesting system at least includes a thermoelectric generator that harvests energy from a thermal gradient inside and outside the enclosure. In one aspect, the power system includes an energy storage system. In another aspect, the energy storage system includes a battery. In some examples, the porthole door is pivotally coupled to the panel via a hinge, and wherein the battery for the energy storage system is contained within the hinge. In some examples, the power system receives energy at least in part from an energy harvesting system, and wherein the energy harvested by the energy harvesting system is stored within the energy storage system. In one aspect, the energy for emitting the light is provided exclusively by the power system.

In one aspect, the panels include an opening panel that is pivotable into an unlocked position to provide access within the enclosure. In some examples, the system can also include a panel detection system that detects when the opening panel is in the unlocked position, a panel lighting system operatively coupled to the panel detection system, wherein the panel lighting system is configured to emit light when the opening panel is detected to be in the unlocked position, and a panel power system that provides energy to the panel lighting system for emitting the light. In some examples, the panel power system and the power system share at least one of an energy harvesting system for harvesting energy and an energy storage system for storing energy.

Another aspect generally relates to an infant care station system to enclose an infant on a mattress. The system includes a base that supports the mattress and panels that extend upwardly from the base to together form an enclosure around the mattress. First and second portholes are defined through the panels, where the first and second portholes provides access into the enclosure. First and second porthole doors correspond to the first and second portholes, respectively, each having locked and unlocked positions, where the first and second porthole doors cover the first and second portholes only in the locked positions, respectively. First and second detection systems correspond to the first and second portholes, respectively, which detect when the first and second porthole doors are in the unlocked positions, respectively. First and second lighting systems are operatively coupled to the first and second detection systems, respectively, wherein the first and second lighting systems are configured to emit light when the first and second porthole doors are detected to be in the unlocked position, respectively. First and second power systems correspond to the first and second porthole doors, respectively, which provide energy to the first and second lighting system for emitting the light, respectively.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

Embodiments of the present disclosure will now be described, by way of example, with reference to FIGS. 1-8. Infant care stations can provide microenvironments for infant patients receiving medical care. Infant care stations, as referred to herein, can include incubators, warmers, or devices that support one or more features of incubators and warmers. In some examples, the infant care stations can enable clinicians to access the patient by opening porthole doors in the side panels of the infant care stations. There is a risk of infants falling out of open porthole doors, or open side panels of infant care stations mistakenly left unlatched. This may occur if a user intentionally leaves a porthole open, for example for cooling, or accidentally if a porthole is mistakenly left open or bumped into an open position without the user noticing. Additional circumstances arising to open porthole doors or panels include unlatching due to broken latching mechanisms, obstructions preventing the detection of an open porthole, such as a fabric cover being positioned over a portion of the infant care station, or the like.

The present disclosure generally relates to systems and methods for indicating when a porthole door of an infant care station is open, and particularly by providing illumination of the porthole door or other regions of the infant care station when the porthole door, panel, or lid are open. Indicating when a porthole door is open in an infant care station can have the advantage of providing an additional safety mechanism to prevent an infant from accidentally falling or otherwise exiting an infant care station through a porthole door. Techniques for indicating when a porthole door of an infant care station is open are described in greater detail below in relation to FIGS. 1-8.

Figure 1:
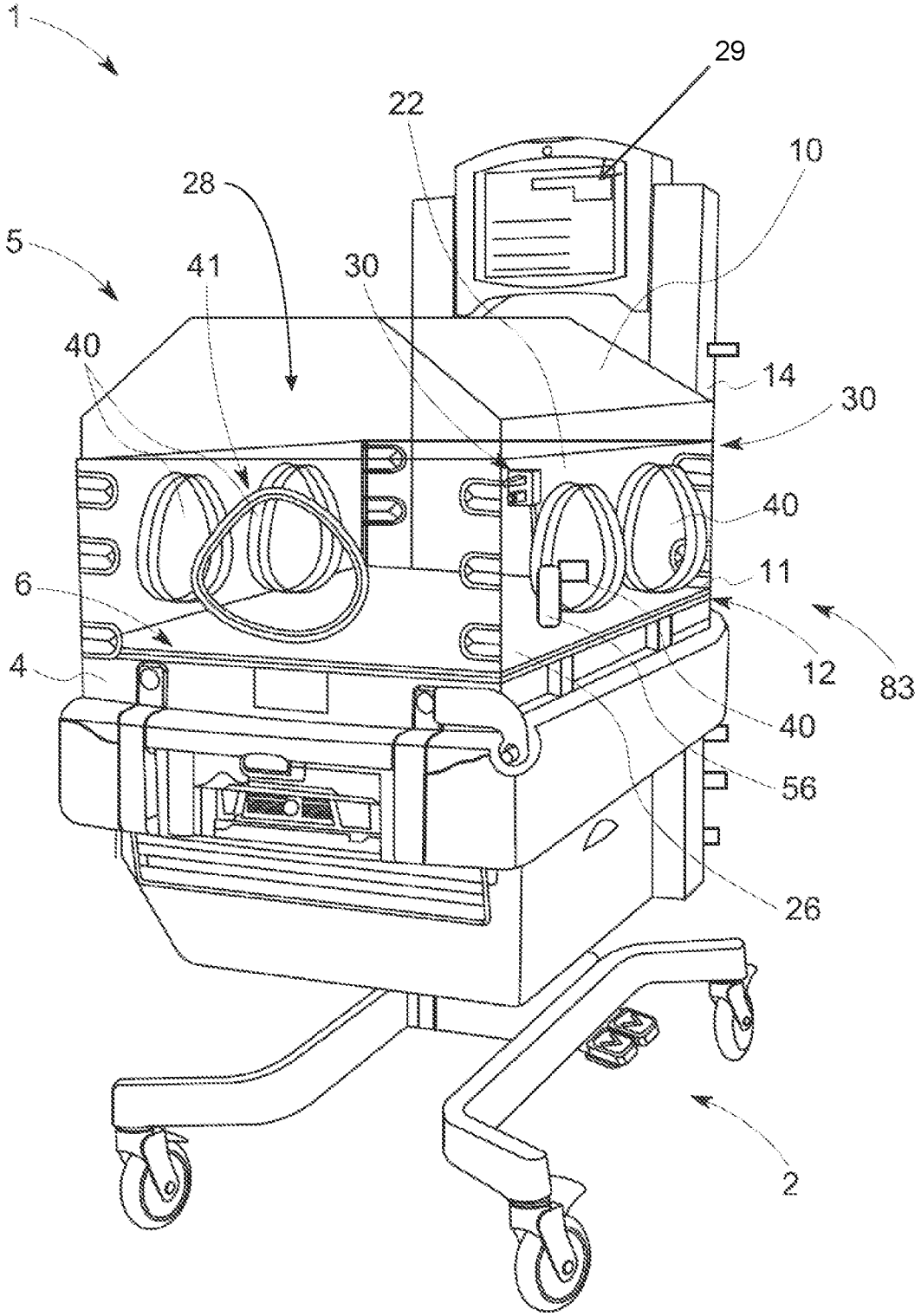
FIG. 1 is an isometric view of an example infant incubator incorporating the systems according to the present disclosure.

FIG. 1 depicts an example incubator system 1 according to the present disclosure. The incubator system 1 is supported by a support 2, which in the present example includes castors in a manner known in the art. The support 2 forms a basis for mounting the base 4 of the incubator system 1, which includes a series of panels 11 that extend upwardly from the base 4 and substantially surround a mattress 6 for receiving the infant thereon. In this manner, an enclosure is formed by the panels 11 to retain the infant within the incubator system 1. The panels 11, presently shown to be on the left and right side, include a pivot end 12 opposite an upper end 14. A hinge 26 is provided at the pivot end 12 such that through actuation of a latch 30, the panel 11 may be pivoted to an open position to provide access to an infant within the incubator system 1. A lid or canopy 10 is also provided, which is supported upon the panels 11 to form an overall transparent enclosure for the infant resting on the mattress 6.

The panels 11 and the lid 10 can define a microenvironment 28 contained within these structures. In some examples, the incubator system 1 is configured such that the microenvironment 28 surrounds the infant patient (not depicted) such that the infant patient is only exposed to a controlled combination of environmental conditions (temperature, humidity, O.sub.2 concentration, etc.) selected by a clinician to promote the health and wellbeing of the infant patient.

As also shown in FIG. 1, a series of portholes 41 are provided in the sides of the incubator system 1, including the panels 11 previously discussed. The porthole doors 40 are provided for selectively closing the portholes 41, with the porthole doors 40 including a pivot end 42 opposite an open end 44.

In some examples, the incubator system 1 can also include a graphical display 29 that is operated by a processor (not depicted) to present a graphical user interface (GUI) (not depicted). In the example illustrated, the graphical display 29 is a touch-sensitive graphical display and the GUI can be configured to specifically respond to inputs made by a clinician received through the touch-sensitive graphical display. During normal operation, the touch-sensitive graphical display 29 and touch-sensitive configured GUI are used to control various functions of the incubator system 1. The GUI can present a variety of information, such as the air temperature and alarm indications. In some examples, the GUI can also present, display, or otherwise provide an indication that a porthole door 40 is open in addition to the porthole door 40 being illuminated by techniques described herein.

Figure 2A:
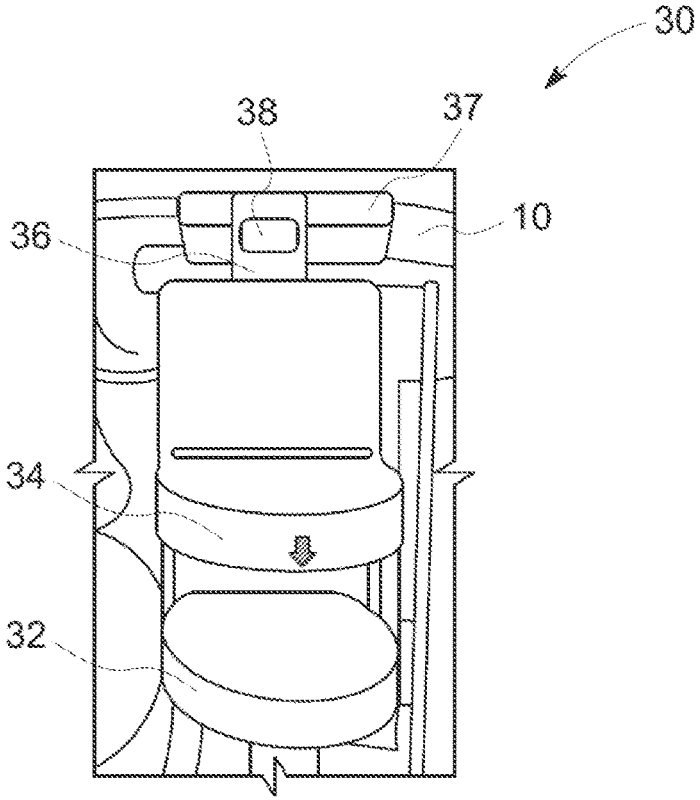
PRIOR ART FIG. 2A
FIGS. 2A and 2B depict a prior art latch used for closing a panel in an infant incubator.
Figure 2B:
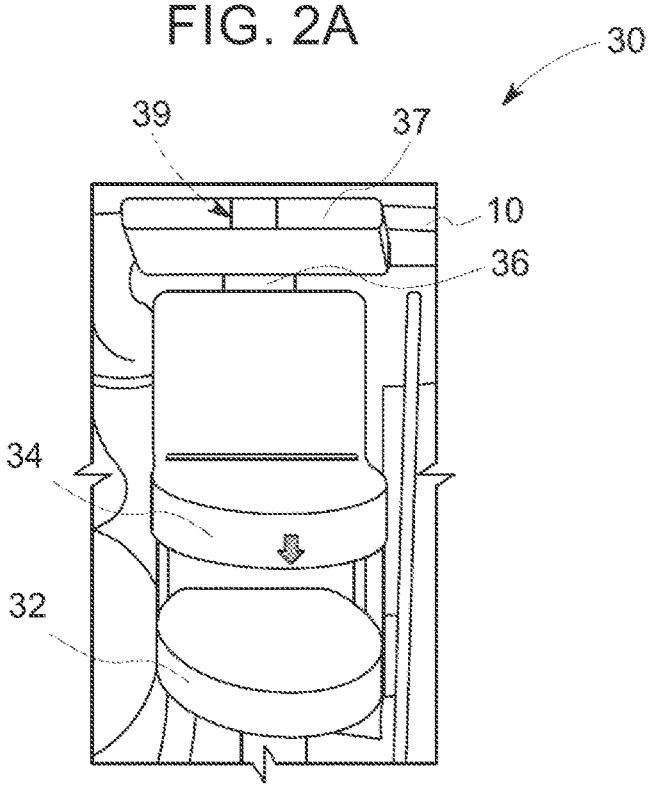
PRIOR ART FIG. 2B

FIGS. 2A and 2B depict a prior art latch used for closing a panel in an infant incubator. As shown in FIGS. 2A and 2B, a different type of latch 30 is provided for locking the panels 11, which in the present example includes stationary portions 32 and moving portions 34 that may be pinched together to retract a locking tab 36 therewith. The locking tab 36 is receivable within a latch tab opening 39 defined within a latch receiver 37, such as may be coupled to the lid 10, whereby the locking tab 36 then prevents the panel 11 from opening unless the moving portion 34 is moved downwardly towards the stationary portion 32. In certain embodiments, such as that shown in FIG. 2A, an unlock indicator 38 is visible on the locking tab 36 when the locking tab 36 is not retracted, but is also not properly received within the latch tab opening 39 that would indicate proper locking and securement of the panel 11. This unlock indicator 38 is merely a rectangular shaped sticker shown in red, which is meant to draw the attention of a user that the panel 11 and particularly its latch 30 has not been properly secured. However, the unlock indicator 38 is subtle and further improvement is necessary to prevent injury to infants when panels 11 or portholes doors 40 are open or at risk of opening inadvertently. It should further be noted that in prior systems, it is common that no indication is provided at all that the porthole door 40 is open, other than a user visually noting an open porthole 41 (in other words, the porthole door 40 being pivoted slightly open or away from the panel 11 or other sidewall of the incubator system 1). It will be recognized that the porthole door 40 being closed and locked by the latch 30 is also referred to herein as being in the locked position, whereas any position in which the latch 30 is not locking the porthole door 40 closed (i.e., is unlocked) may be simply referred to as being in the unlocked position, regardless of how far the porthole door 40 is physically open.

Figure 3:
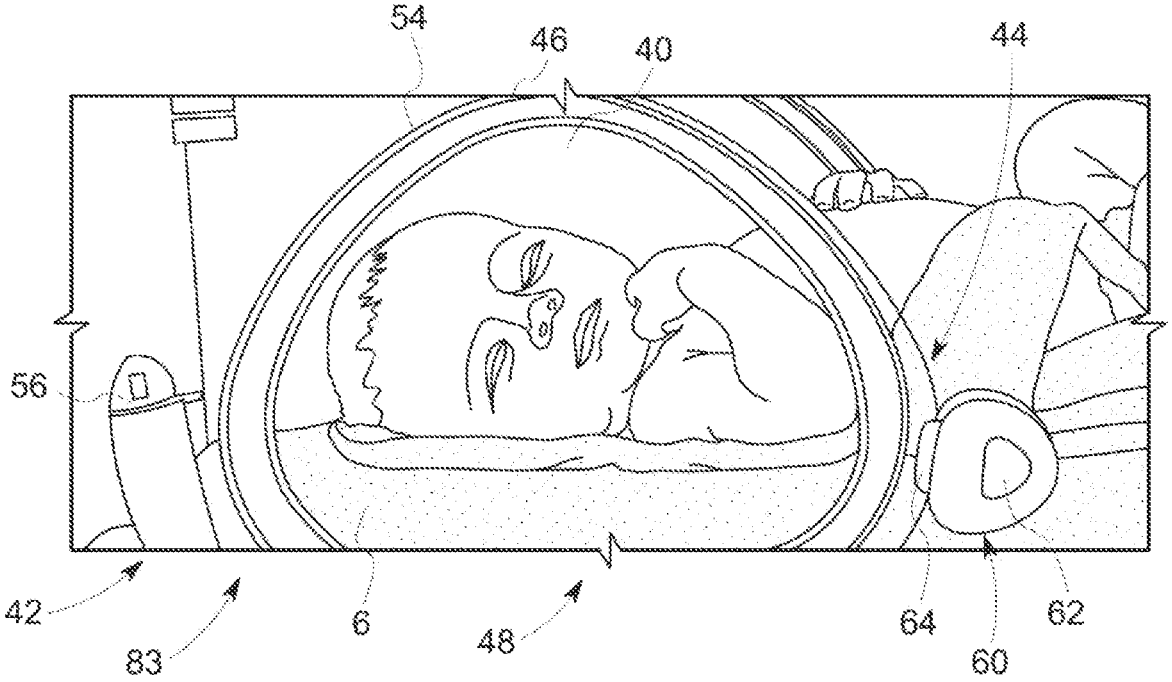
FIG. 3 is a side close-up view of the porthole of an incubator according to the present disclosure.

FIG. 3 is a side close-up view of the porthole of an incubator according to the present disclosure. As shown in FIG. 3, the porthole doors 40 further include a top 46 opposite a bottom 48, and define an edge 54 around a perimeter of each porthole door 40. The porthole door 40 can be pivotally coupled to the sidewall or panel 11 of the incubator system 1 via a hinge 56. In some examples, the porthole door 40 is selectively opened by actuation of a latch 60, which in the present example is actuated by a user pressing at a press location 62 such that the locking catch 64 is released from the open end 44 of the porthole door 40, allowing the porthole door 40 to pivot open. In some examples, any suitable type of latch can be used by the incubator system 1 to enable opening and closing the porthole doors 40. As discussed above, an incubator system 1, or any other suitable infant care station, can include any number of porthole doors 40 located within one or more panels 11.

Figure 4A:
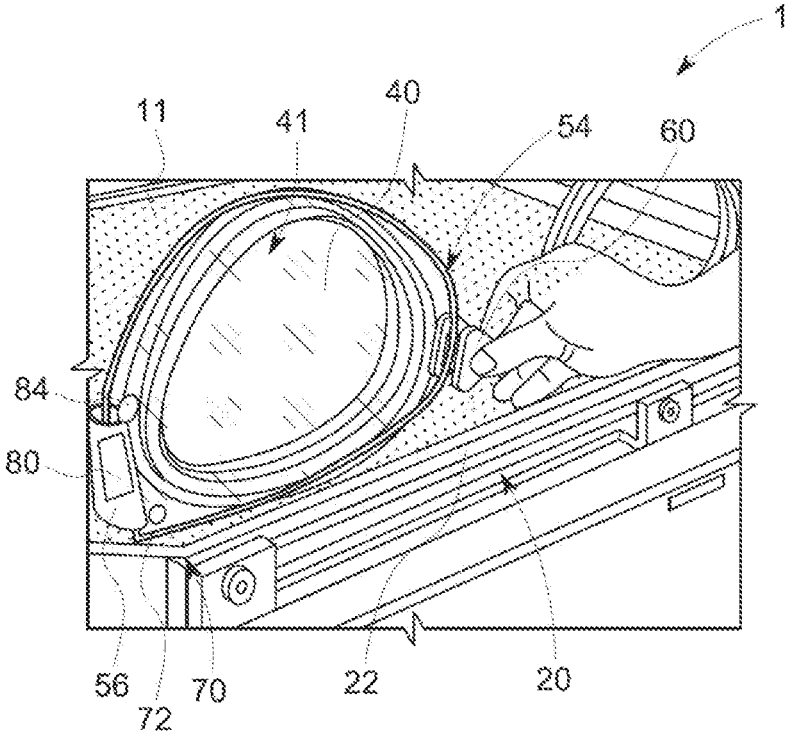
FIGS. 4A and 4B are isometric views of the porthole of FIG. 3, shown in open and open illuminated states according to the present disclosure.

FIG. 4A depicts a porthole door 40 in an open position for an incubator system 1 according to the present disclosure. As shown in the depiction of FIG. 4A, the porthole door 40 opens in a customary manner, but the incubator system 1 further includes a detection system 83 for detecting when the porthole door 40 is not locked (e.g., is open), as well as a power system 80 that powers a lighting system 70 when the porthole door 40 is open to provide an indication of such state to the user. In some embodiments, the detection system 83 is a switch 84, such as a limit switch, among any other suitable switch. It will be recognized that while the switch 84, lighting system 70, and power system 80 are depicted in particular locations relative to the porthole door 40, such as within or near the hinge 56 pivotally coupling the porthole door 40 to the panel 11, other locations for positioning these components, or further divisions or combinations thereof, are also anticipated by the present disclosure. For example, in another embodiment the switch 84 can be provided under or within the latch 30 such that the switch 84 is actuated by fully closing the porthole door 40 such that it is locked by the latch 30.

Figure 4B:
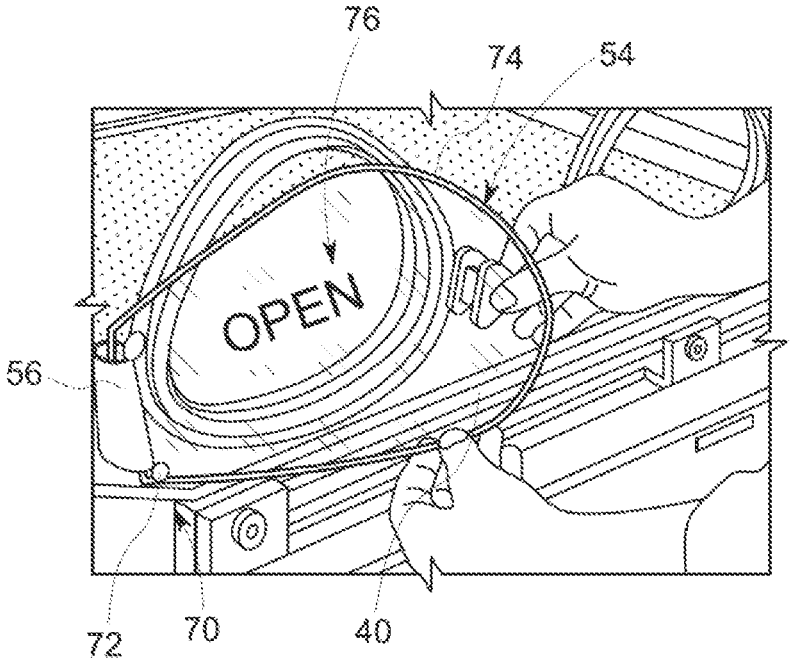

FIG. 4B depicts the effect of the switch 84 detecting the opening of the porthole door 40, which is that the lighting system 70 provides power via the power system 80 to an LED 72, which consequently provides illumination of the edge 54 of the porthole door 40 via a scattering rim 74 defined therewith. In some examples, any number of LEDs 72 can illuminate the edge 54 of a porthole door 40. The scattering rim 74 may, in certain examples, be produced via laser engraving, such as is commercially known for artwork and other signs made of acrylic having labels, names, and/or characters defined within the acrylic that are visible when light is projected through the porthole door 40. It will be recognized that other means for illuminating the edge 54 of the porthole door 40 are also anticipated by the present disclosure.

In the embodiment of FIG. 4B, a further indication of the porthole door 40 being open is provided by the text 76 provided in the center of the porthole door 40, which as discussed above may be produced via laser engraving, or using any other suitable technique. In some examples, the text 76 can reside within any portion of the porthole door 40, such as the top, bottom, or side of the porthole door 40. By providing the text 76 via a mechanism such as laser engraving, a message such as "open," or any other suitable text comprising any number of alphanumerical characters, may be highly visible when illuminated to indicate that the porthole door 40 is open, but invisible or nearly invisible when the porthole door 40 is properly closed, preventing any obscuring of the view of the infant within the incubator system 1.

In some examples, the use of a scattering rim 74 and text 76, particularly through the use of laser engraving, can enable a single LED 72 to provide illumination for the entire porthole door 40. However, it will be recognized that in the system previously described, a separate configuration of lighting systems 70 can be provided for each porthole door 40 independently in addition to a power system 80 in some examples.

In further embodiments, the porthole door 40 may be designed or may further include shielding such that any light provided by the lighting system 70 is visible only from the outside of the incubator system 1, and therefore is not disturbing to an infant resting on the mattress 6 therein. The shielding can include scattering the light in an outward direction away from an infant care station.

In certain embodiments, a similar configuration of lighting system 70 and switch 84 may also be provided for the panel 11, and/or lid 10 such that the edges thereof are also illuminated in a similar manner when left in the open position.

In some examples, the additional cost and complexity of providing a wired system to provide this illumination of the porthole door 40 (or other illuminated components such as panels 11 or lids 10) may not be desirable in all applications of incubator systems 1. Therefore, while certain embodiments may include wires 82 between components, further embodiments are provided herein for minimizing or eliminating the needs for wires, and also for providing for energy harvesting to allow each porthole door 40 to be completely independent of other porthole doors 40, and independent of any centralized power system.

Figure 5:
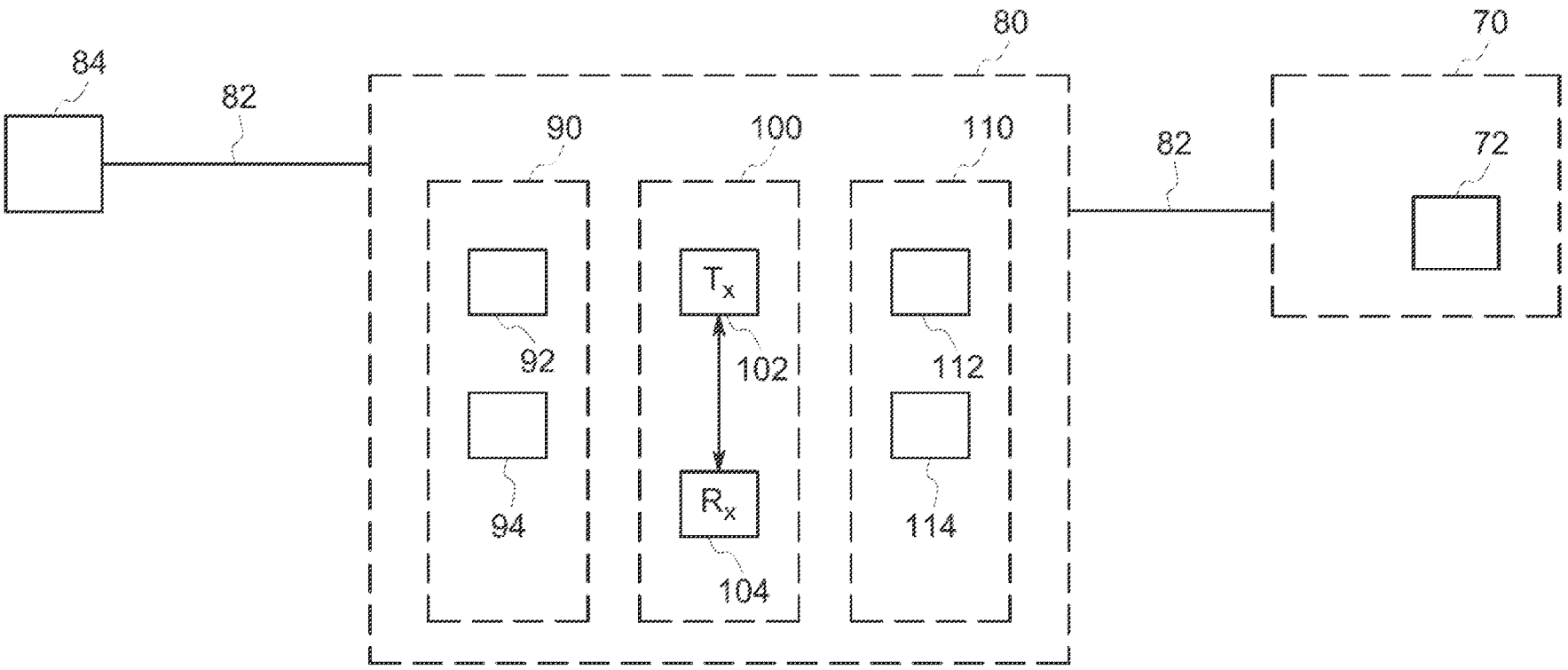
FIG. 5 depicts an example schematic for illuminating the porthole door as shown in FIG. 4B when open according to the present disclosure.

FIG. 5 depicts an example schematic for illuminating a porthole door 40 when open. As shown, a switch 84, which may be a limit switch, or any other suitable type of switch, is provided, in this case in a wired fashion using the wire 82, to a power system 80. The power system 80 may include an energy harvesting system 90 such as a light harvester 92, and/or a thermal harvester 94. For example, a light harvester 92 may include a solar-based system configured to extract energy from lighting within the room in which the incubator system 1, or any suitable infant care station, is positioned or otherwise located. Alternatively, or in addition, a thermal harvester 94, such as a thermoelectric energy harvesting system may be provided to harvest energy based on the thermal gradient between the temperature difference inside the microenvironment of the incubator system 1 versus that of the room in which the incubator system 1 is positioned or otherwise located. In certain examples, the thermal gradient can be 20° C., or any other suitable temperature, outside the incubator system 1, but 37° C. inside the microenvironment, providing a $\Delta$ of 17° C. for harvesting energy through the Seebeck Effect. Example thermoelectric gradient systems, which can be any thermoelectric cooler (TEC) include the microgenerator module produced by KELK Limited, the Thermomobility WPG-1 by Laird, or the Evergen Power Strap, and/or plate exchanger systems produced by Marlo. In some examples, by using a thermal energy harvesting technique, there are no moving parts and complexities for providing power to the power system 80 are minimized. However, a thermal energy harvesting component may not have a particularly high efficiency.

In some examples, in addition to the energy harvesting system 90, an energy storage system 110 is provided within the power system 80. The energy storage system 110 can include batteries 112, and/or ultra-capacitors 114, for example, which receive the energy harvested from the energy harvesting system 90. The batteries 112 and the ultra-capacitors 114 can store this energy for use when needed to illuminate one or more LEDs 72 in response to an open porthole door 40. In this manner, although the power produced by any of the energy harvesting systems 90 may be below a threshold, over time the system will provide sufficient power to the energy storage system 110 to achieve the minimal energy consumption requirements of the one or more LEDs 72 within the lighting system 70. The energy storage system 100 can provide for substantial runtime of the one or more LEDs 72 when the porthole door 40 is open, which is generally not for long periods of time.

In addition, or in conjunction with the energy harvesting system 90 and the energy storage system 110 previously discussed, the power system 80 of FIG. 5 can further include a wireless energy transfer system 100, which includes a transmitter 102 and a receiver 104. In this example, power may be wirelessly transmitted from one location, or a central location within the incubator system 1 or any suitable infant care station to each of the receivers 104 associated with each of the porthole doors 40. This may be provided as RF energy, using magnetic coils, and/or other wireless energy transfer systems 100. The energy transfer system 100 can receive or otherwise obtain power from any suitable electrical source, such as an alternating current (AC) electrical plug, a direct current (DC) battery external to the incubator system 1 or an infant care station, the energy storage system 100, or the energy harvesting system 90, among others. In some examples, the incubator system 1 or an infant care station can include one or more lighting systems 70 to illuminate the one or more LEDs 72 in response to an open porthole door 40. For example, each porthole door 70 can have a separate lighting system 70, a single lighting system 70 can provide power to the LEDs 72 of multiple porthole doors 40, or any combination thereof. In some examples, a lighting system 70 of the incubator system 1 or any suitable infant care station can illuminate a porthole door 40 using a light emitting diode (LED), an organic light emitting diode (OLED), a flashing LED, one or more LEDs with any suitable colored output, or any other suitable light source such as incandescent, fluorescent, laser, neon, tungsten-halogen, or sodium-vapor bulbs, among others.

Figure 6:
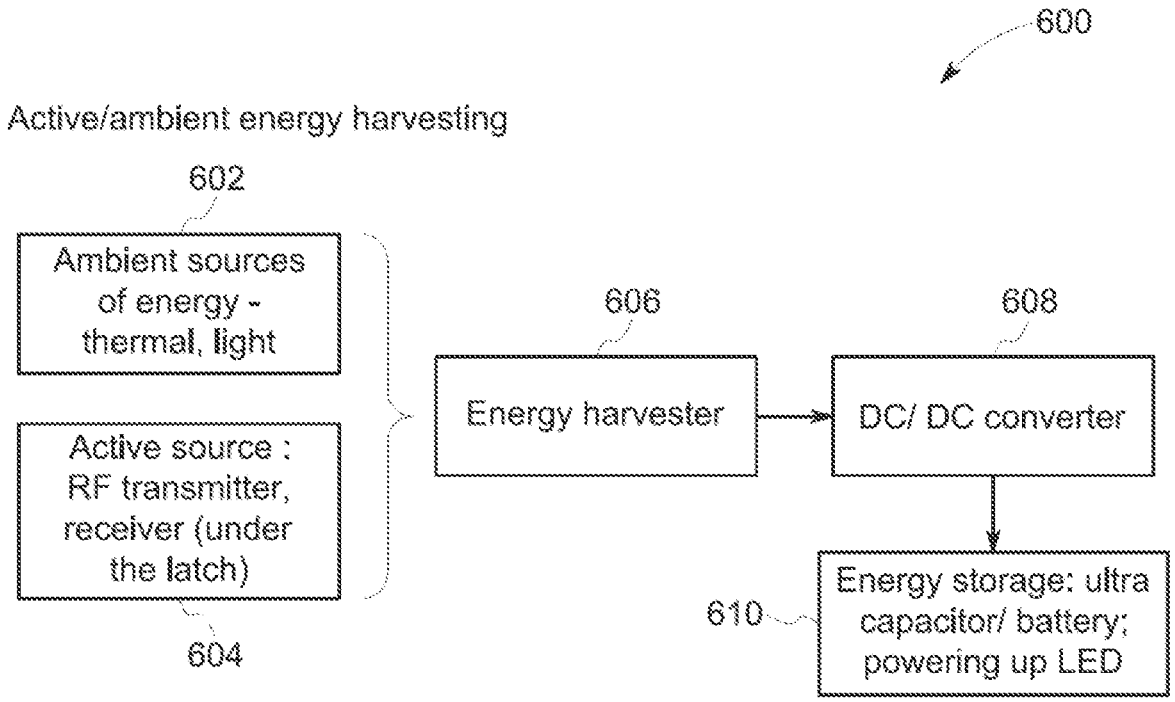
FIG. 6 depicts a method for providing energy to power a system according to the present disclosure.

FIG. 6 depicts an example method 600 for providing power within a power system 80 as previously discussed. For example, the method 600 can include providing power using techniques for harvesting energy from various ambient sources of energy in step 602, such as may be achieved via a light harvester 92 and/or a thermal harvester 94 as previously discussed. In addition, or in the alternative, energy may be received via an active source of energy in step 604, such as via a wireless energy transfer system 100 as previously discussed (e.g., an RF transmitter that may have a receiver 104 under the latch 60 of the porthole door 40 that receives energy wirelessly from a transmitter 102). The energy from the ambient sources and/or active sources can be received within the power system 80 in step 606 and then conditioned through a DC/DC converter in step 608, for example to step up the voltage. This energy can then be stored long term in an energy storage device in step 610, such as within an energy storage system 110 as previously discussed.

Figure 7:
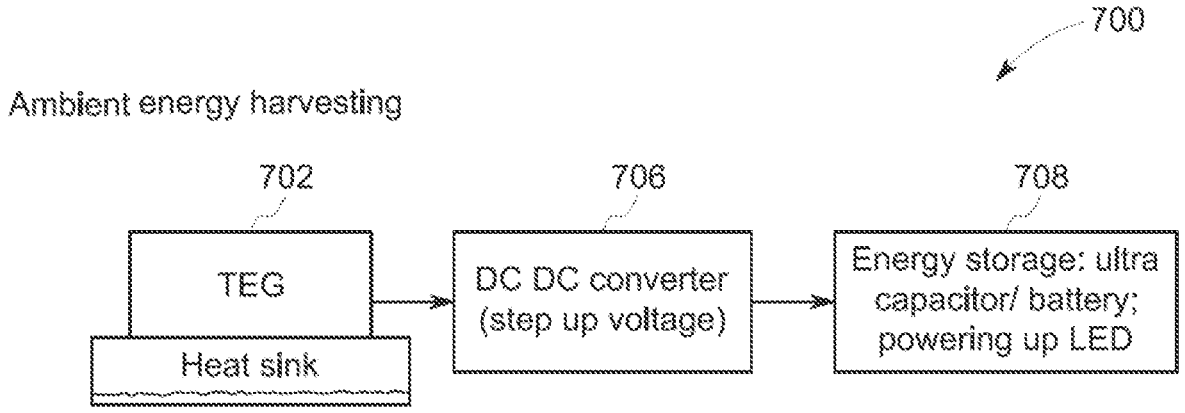
FIG. 7 depicts a method for thermoelectric energy harvesting to power a system according to the present disclosure.

FIG. 7 provides an example method 700 for providing power within the power system 80, specifically via harvesting energy using a thermal harvester 94. In particular, the method 700 can provide for converting heat energy into electrical energy via a thermoelectric generator (TEG) and heat sink in step 702, which can then be conditioned through a step up voltage DC/DC converter in step 706 similar to that previously discussed in step 606 of FIG. 6. This power can then be received in the energy storage system 110 in step 708 as previously described.

In total, the systems and methods presently described provide for simple, and in certain cases, wireless independent indications that a porthole door 40, a panel 11, and/or a lid 10 have been left open, providing a simple visual indicator without adding substantial complexity to the incubator system 1 or any suitable infant care station. In some examples, the panel 11 or the lid 10 can include text or any other suitable indicator representing that the panel 11 or the lid 10 is in an open position. For example, a panel 11 or a lid 10 can also be illuminated by a lighting system 70 so that any text within the panel 11 or the lid 10 can be viewed by a user when the panel 11 or the lid 10 is in an open position.

In some examples, the panel 11 can be an opening panel that is pivotable into an unlocked position to provide access within an enclosure of an infant care station. In some examples, a panel detection system can detect when the opening panel is in the unlocked position and a panel lighting system operatively coupled to the panel detection system can be configured to emit light when the opening panel is detected to be in the unlocked position. A panel power system can provide energy to the panel lighting system for emitting the light. In some examples, the panel power system and the power system share at least one of an energy harvesting system for harvesting energy and an energy storage system for storing energy.

Figure 8:
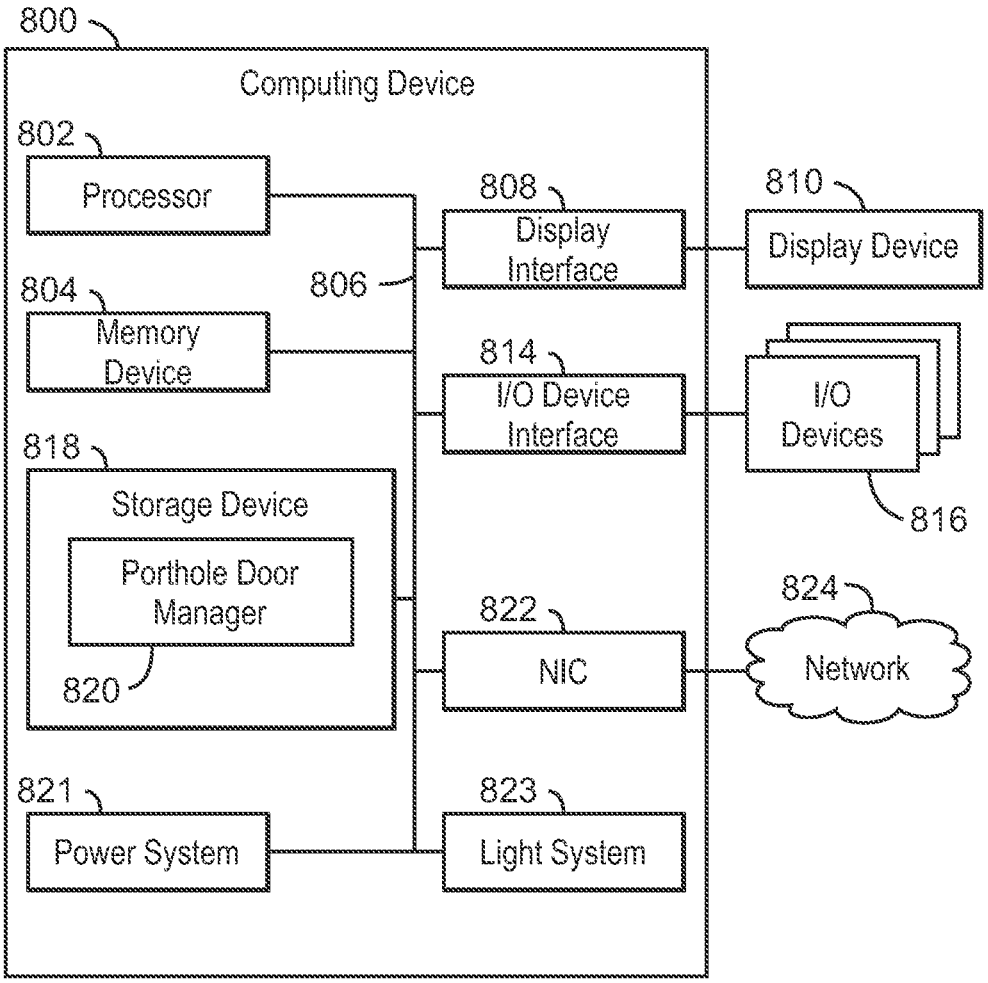
FIG. 8 is a block diagram of an example of a computing device that can indicate an open porthole door in an infant care station.

FIG. 8 is a block diagram of an example of a computing device that can indicate an open porthole door in an infant care station. The computing device 800 may be, for example, an infant care station, a laptop computer, a desktop computer, a tablet computer, or a mobile phone, among others. The computing device 800 may include a processor 802 that is adapted to execute stored instructions, as well as a memory device 804 that stores instructions that are executable by the processor 802. The processor 802 can be a single core processor, a multi-core processor, a computing cluster, or any number of other configurations. The memory device 804 can include random access memory, read only memory, flash memory, or any other suitable memory systems. The instructions that are executed by the processor 802 may be used to implement a method that can indicate an open porthole door in an infant care station, as described in greater detail above in relation to FIGS. 1-7.

The processor 802 may also be linked through the system interconnect 806 (e.g., PCI, PCI-Express, NuBus, etc.) to a display interface 808 adapted to connect the computing device 800 to a display device 810. The display device 810 may include a display screen that is a built-in component of the computing device 800. The display device 810 may also include a computer monitor, television, or projector, among others, that is externally connected to the computing device 800. The display device 810 can include light emitting diodes (LEDs), and micro-LEDs, Organic light emitting diode OLED displays, among others.

The processor 802 may be connected through a system interconnect 806 to an input/output (I/O) device interface 814 adapted to connect the computing device 800 to one or more I/O devices 816 The I/O devices 816 may include, for example, a keyboard and a pointing device, wherein the pointing device may include a touchpad or a touchscreen, among others. The I/O devices 816 may be built-in components of the computing device 800 or may be devices that are externally connected to the computing device 800.

In some embodiments, the processor 802 may also be linked through the system interconnect 806 to a storage device 818 that can include a hard drive, an optical drive, a USB flash drive, an array of drives, or any combinations thereof. In some embodiments, the storage device 818 can include any suitable applications. In some embodiments, the storage device 818 can include a porthole door manager 820. In some embodiments, the porthole door manager 820 can modify the operation of a power system 821, a light system 823, or the like. The power system 821 can include any number of batteries, capacitors, ultra-capacitors, thermal energy harvesting systems, AC electrical connections, wireless power transmitting components, and the like. The power system 821 can provide power to the light system 823 so that a porthole door can be illuminated whenever the porthole door is in an open position. The light system 823 can include any number of light sources, such as one or more LED lights, fluorescent lights, or any other suitable lights as described above.

For example, the porthole door manager 820 can modify, change, or otherwise alter a color provided by the light system 823, an amount of time the light system 823 is activated in order to illuminate a light, or a combination thereof. The porthole door manager 820 can also provide any suitable combination of audio feedback, visual feedback, haptic feedback, and light feedback. In some examples, the porthole door manager 820 can provide instructions regarding how to alternate between power sources used to provide power to the lights of the light system 823. For example, the porthole door manager 820 can indicate when to provide power to the light system 823 using the power system 821, an external battery, a thermal harvester, or any other suitable power source. The porthole door manager 820 can also indicate when to initiate a change from using a first power source to a second power source.

In some examples, the porthole door manager 820 can also store and track times when a porthole door is in an open position and store and track conditions of the microenvironment along with the times when the porthole door is in an open position. In some examples, the porthole door manager 820 can generate an alert in response to detecting a porthole door that is open for a period of time that exceeds a predetermined threshold or in response to detecting a porthole door opening a number of times within a time period.

In some examples, a network interface controller (also referred to herein as a NIC) 822 may be adapted to connect the computing device 800 through the system interconnect 806 to a network 824. The network 824 may be a cellular network, a radio network, a wide area network (WAN), a local area network (LAN), or the Internet, among others. The network 824 can enable data, such as alerts, among other data, to be transmitted from the computing device 800 to remote computing devices, remote display devices, and the like. In some examples, the porthole door manager 820 can transmit, using the NIC 822 and the network 824, an alert to any suitable external device such as a mobile device, a computing device, or a device in a hospital setting, among others.

In some examples, the NIC 822 can wirelessly transmit data related to an open porthole door, a panel, or a lid. The wireless transmission of data can enable an infant care station to provide data indicating an open porthole door, lid, or panel without adding any wires proximate to the porthole door, lid, or panel.

It is to be understood that the block diagram of FIG. 8 is not intended to indicate that the computing device 800 is to include all of the components shown in FIG. 8. Rather, the computing device 800 can include fewer or additional components not illustrated in FIG. 8 (e.g., additional memory components, embedded controllers, additional modules, additional network interfaces, etc.). Furthermore, any of the functionalities of the porthole door manager 820 may be partially, or entirely, implemented in hardware and/or in the processor 802. For example, the functionality may be implemented with an application specific integrated circuit, logic implemented in an embedded controller, or in logic implemented in the processor 802, among others. In some embodiments, the functionalities of the porthole door manager 820 can be implemented with logic, wherein the logic, as referred to herein, can include any suitable hardware (e.g., a processor, among others), software (e.g., an application, among others), firmware, or any suitable combination of hardware, software, and firmware.

The functional block diagrams, operational sequences, and flow diagrams provided in the Figures are representative of example architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A system for safely containing an infant on a mattress, the system comprising:

a plurality of panels that extend upwardly from a base that supports the mattress, wherein the plurality of panels and the base form an enclosure around the mattress, and wherein at least one of the plurality of panels is configured to have a locked position and an unlocked position;

a detection system that detects when the at least one of the plurality of panels is in the unlocked position;

a lighting system operatively coupled to the detection system, wherein the lighting system is configured to emit light when the at least one of the plurality of panels is detected to be in the unlocked position; and a power system that provides energy to the lighting system for emitting the light.

2. The system according to claim 1, further comprising a latch for selectively unlocking the at least one of the plurality of panels, wherein the detection system is a limit switch incorporated within the latch.

3. The system according to claim 1, wherein the light is emitted by only one LED.

4. The system according to claim 1, wherein a text message, a visual indication, or a combination thereof is defined within the at least one of the plurality of panels such that the text message, the visual indication, or the combination thereof is illuminated by the light emitted from the lighting system.

5. The system according to claim 1, wherein the power system receives energy at least in part from an energy harvesting system.

6. The system according to claim 5, wherein the energy harvesting system at least includes a thermoelectric generator that harvests energy from a thermal gradient inside and outside the enclosure.

7. The system according to claim 1, wherein the power system includes an energy storage system.

8. The system according to claim 7, wherein the energy storage system includes a battery.

9. The system according to claim 8, wherein a porthole door is pivotally coupled to the at least one of the plurality of panels via a hinge, and wherein the battery for the energy storage system is contained within the hinge.

10. The system according to claim 7, wherein the power system receives energy at least in part from an energy harvesting system, and wherein the energy harvested by the energy harvesting system is stored within the energy storage system.

11. The system according to claim 1, wherein an edge of the at least one of the plurality of panels in the unlocked position is configured to scatter light such that the edge is illuminated by the emitted light.

12. A method comprising:

detecting when at least one of a plurality of panels is in an unlocked position, wherein the plurality of panels extend upwardly from a base that supports a mattress in an infant care station, wherein the plurality of panels and the base form an enclosure around the mattress, and wherein the at least one of the plurality of panels is configured to have a locked position and the unlocked position;

providing energy to a lighting system for emitting light; and emitting the light, using the lighting system, when the at least one of the plurality of panels is detected to be in the unlocked position.

13. The method of claim 12, further comprising selectively unlocking, using a latch, the at least one of the plurality of panels.

14. The method of claim 12, wherein the light is emitted by one LED.

15. The method of claim 12, further comprising providing a text message within the at least one of the plurality of panels such that the text message is illuminated by the light emitted from the lighting system.

16. The method of claim 12, comprising receiving energy at least in part from an energy harvesting system.

17. The method of claim 16, wherein the energy harvesting system at least includes a thermoelectric generator that harvests energy from a thermal gradient inside and outside the enclosure.

18. The method of claim 12, comprising providing the energy from a power system that includes an energy storage system.

19. The method of claim 18, wherein the energy storage system stores the energy using a battery.

20. The method of claim 19, wherein an edge of the at least one of the plurality of panels is configured to scatter light such that the edge is illuminated by the emitted light, wherein the edge is laser etched.

* * * * *